US006871697B2

(12) United States Patent
Albright et al.

(10) Patent No.: US 6,871,697 B2
(45) Date of Patent: Mar. 29, 2005

(54) INTEGRATED FLUID RESERVOIR AND HEAT EXCHANGER DUCTS

(75) Inventors: Larry E. Albright, Gwinner, ND (US); Lonnie D. Hoechst, Gwinner, ND (US); Daniel A. Frederick, Forman, ND (US)

(73) Assignee: Clark Equipment Company, Woodcliff Lake, NJ (US)

( * ) Notice: Subject to any disclaimer, the term of this patent is extended or adjusted under 35 U.S.C. 154(b) by 214 days.

(21) Appl. No.: 10/123,826

(22) Filed: Apr. 15, 2002

(65) Prior Publication Data

US 2003/0136544 A1 Jul. 24, 2003

Related U.S. Application Data

(60) Provisional application No. 60/349,391, filed on Jan. 18, 2002.

(51) Int. Cl.[7] ..... B60K 11/04; B62D 25/10; F01P 11/02; F01P 7/10; F01P 9/04

(52) U.S. Cl. ..... 165/51; 165/41; 165/122; 123/41.49; 180/68.1; 180/68.4

(58) Field of Search ..... 165/51, 41, 122; 123/41.49; 180/68.1, 68.4

(56) References Cited

U.S. PATENT DOCUMENTS

| | | | | |
|---|---|---|---|---|
| 3,996,999 A | | 12/1976 | Termont et al. | 165/41 |
| 4,339,014 A | | 7/1982 | Berth et al. | 180/54 A |
| 4,441,463 A | * | 4/1984 | Rest et al. | 123/41.27 |
| 4,696,361 A | | 9/1987 | Clark et al. | 180/68.4 |
| 4,815,550 A | * | 3/1989 | Mather et al. | 180/68.1 |
| 4,903,760 A | | 2/1990 | Joshi et al. | 165/41 |
| 4,962,825 A | * | 10/1990 | Albright et al. | 180/292 |
| 4,979,584 A | * | 12/1990 | Charles | 180/68.1 |
| 5,012,768 A | | 5/1991 | Roschinski | 123/41.49 |
| 5,046,554 A | * | 9/1991 | Iwasaki et al. | 165/140 |
| 5,234,051 A | | 8/1993 | Weizenburger et al. | 165/41 |
| 5,649,587 A | | 7/1997 | Plant | 165/41 |
| 5,960,899 A | | 10/1999 | Roach | 180/68.4 |
| 5,971,062 A | | 10/1999 | Sadr et al. | 165/104.32 |
| 6,058,903 A | | 5/2000 | Downham | 123/198 E |
| 6,092,616 A | | 7/2000 | Burris et al. | 180/68.1 |
| 6,098,739 A | | 8/2000 | Anderson et al. | 180/312 |
| 6,129,056 A | | 10/2000 | Skeel et al. | 123/41.49 |
| 6,454,527 B2 | * | 9/2002 | Nishiyama et al. | 415/119 |
| 2004/0012125 A1 | * | 1/2004 | Plant et al. | 264/523 |

FOREIGN PATENT DOCUMENTS

| | | |
|---|---|---|
| JP | 63094019 | * 4/1988 |
| JP | 02128919 | * 5/1990 |
| WO | WO01/098099 | * 12/2001 |

* cited by examiner

*Primary Examiner*—John K. Ford
(74) *Attorney, Agent, or Firm*—Westman, Champlin & Kelly

(57) ABSTRACT

A combined liquid tank and fan air flow housing is molded as a unit to combine needed functions in a compact preassembled unit. Separate spaced side tank portions are formed that are joined together with a front end tank to form a central opening with upper and lower ends. The opening is closed with a top plate that defines a plenum chamber and a lower fan support plate that forms a fan chamber in the central opening. A fan in the fan chamber creates an airflow from the exterior through the plenum chamber and out lateral ducts formed in the side tank portions. The inlet air flows through an oil cooler, water radiator and if desired, an air conditioner condenser in the plenum chamber. The tank formed is used for storage of hydraulic fluid.

18 Claims, 10 Drawing Sheets

INTEGRATED FLUID RESERVOIR AND HEAT EXCHANGER DUCTS

The present application is based on and claims the benefit of U.S. Provisional Patent Application Ser. No. 60/349,391, filed Jan. 18, 2002, the content of which is hereby incorporated by reference in its entirety.

BACKGROUND OF THE INVENTION

The present invention relates to a unitarily molded fluid reservoir tank for a skid steer loader that forms a fan housing or shroud having passageways for cooling airflow across a hydraulic fluid cooler, an engine radiator if the loader the engine is not air cooled, and when installed, an air conditioner condenser, as well as drawing air from an engine compartment, and for discharging the air laterally out of the loader. The tank is hollow to form the hydraulic fluid reservoir or chamber and is designed to provide sound insulation between the fan and an operator's cab. Fill, inlet and outlet pipes, and a dipstick passage are molded in place.

It has been desirable to make molded tanks that are formed to include cooling ducts or a partial fan shroud as part of a molded unit. U.S. Pat. No. 5,649,587 illustrates a fan shroud that uses a molded housing with twin fan ducts in it, and also outlet connection pipes for a vehicle radiator cooling system.

In a skid steer loader adequate engine and hydraulic system cooling and optional air conditioning heat exchange, as well as a hydraulic reservoir with suitable capacity must be provided in a limited space combining the function efficiently is caused out with the present invention.

SUMMARY OF THE INVENTION

The present invention relates to a unitary, molded tank forming a reservoir for hydraulic fluid and configured to provide a center fan mounting chamber and shroud having airflow ducts for cooling air moved by the fan. Locating holes and inlet and outlet connections to the reservoir are molded unitarily as well. The tank has front and rear tank sections and connecting chambers on lateral sides that are formed by walls which connect the tank sections. The fan is mounted in the center portions of the molded tank on a plate that locates the fan in spacial relationship to the molded duct portions of the tank.

The molded tank surrounds heat exchangers, such as a hydraulic oil cooler or radiator, and when required an engine coolant radiator. Space for mounting an air conditioning condenser is reserved so when a condenser is needed, it can be installed. The integrated reservoir, heat exchanger, fan and duct assembly will mount easily as a unitary assembly into a space behind the operator's cab of a skid steer loader.

Because the tank is molded, the outer shape can be contoured or rounded as desired for aesthetic purposes, as well as for smoothly guiding airflow in the desired directions through the formed ducts.

The molded tank with ducts shape reduces the size of the combined fluid reservoir and loader cooling system that is necessary for operation of the loader, and permits modular assembly of the components that are added within the center portions of the tank, such as heat exchangers, a fan support and a fan, before being installed in the skid steer loader frame. The side tanks or chambers and the connecting chambers are shaped and sized to reduce sloshing of the hydraulic oil to help keep the hydraulic oil from becoming aerated. Because the reservoir extends for a substantial length along the loader frame's longitudinal and latitudinal axes, the locations of hose connections can be distributed so that hydraulic oil contained inside flows considerable distances to promote de-aeration.

The molded tank with ducts is formed by spaced walls around a perimeter of the fan. The double walls and the filling of hydraulic fluid dampen noise from the fan. The molded tank compartment that is positioned adjacent the rear cab wall is full height to provide a substantial reduction in noise and vibration between the fan and the cab. The hydraulic fluid in the tank also dampens noise harmonics for more operator comfort.

DETAILED DESCRIPTION OF THE PREFERRED EMBODIMENTS

Figure 1:
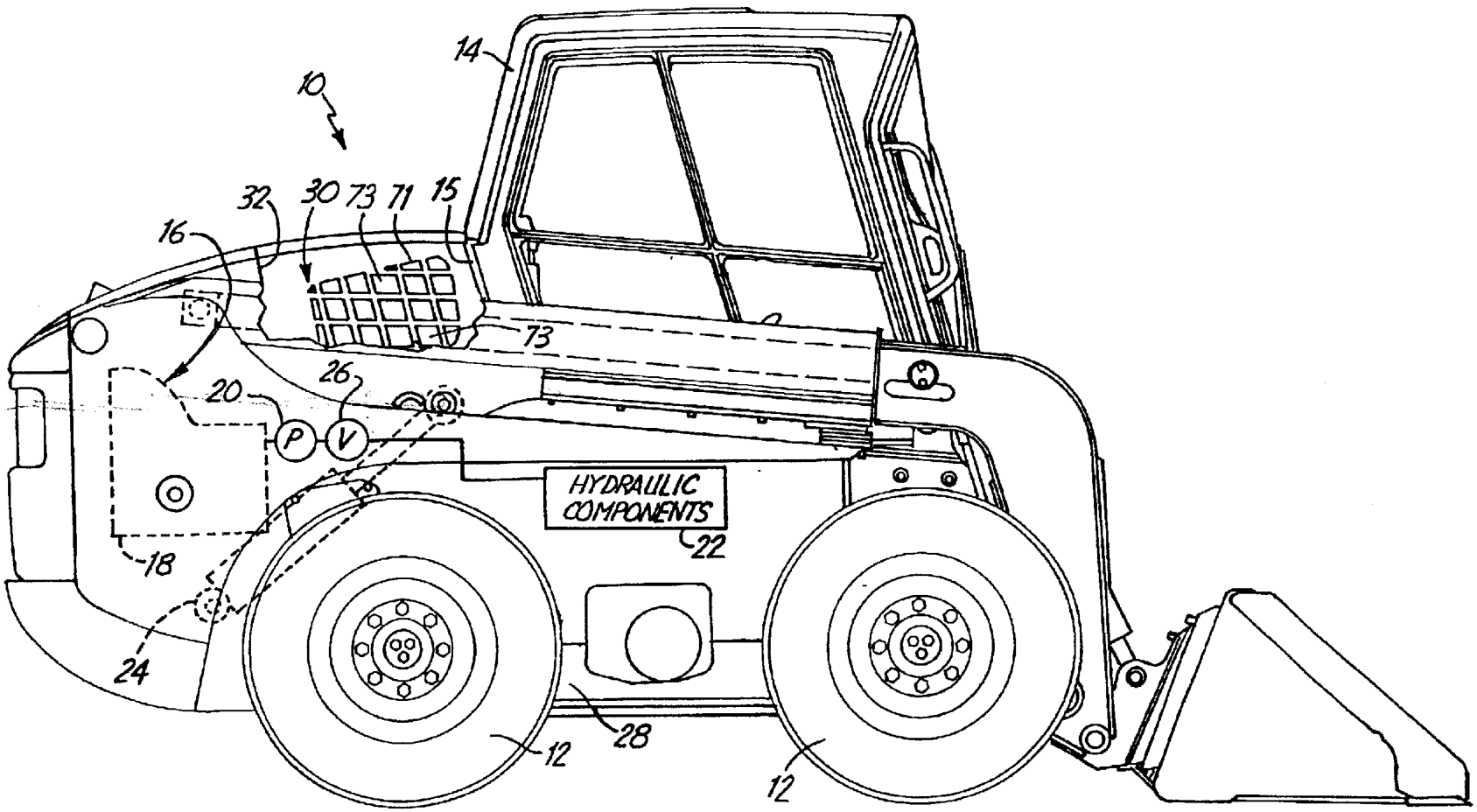
FIG. 1 is a side view of a skid steer loader having a molded tank with ducts made according to the present invention installed therein.

A skid steer loader indicated at 10 in FIG. 1 includes wheels 12, that are supported on the frame 28 of the loader and are driven to move the loader in a normal manner. An operator's cab 14 is located at a forward end of the loader. The skid steer loader 10, as shown, has a rear engine compartment 16 with an engine 18 in the compartment. The engine can either be air cooled or liquid cooled. The present invention provides a molded tank with ducts forming a combined cooling fan and heat exchanger support assembly with airflow ducts, and hydraulic fluid reservoir. The integrated assembly will accommodate a fan that works with either air or liquid cooling for the engine.

The skid steer loader 10 includes a hydraulic pump illustrated schematically at 20, which is driven by the engine 18 and connected to provide hydraulic fluid under pressure to ground drive motors and to components such as lift arm cylinders 24, or other hydraulic components. The hydraulic components are represented at 22. A boom lift cylinder is outlined in dotted lines at 24. The pump 20 is connected to a suitable valve 26, for operating the hydraulic components.

The length of the frame 28 of the skid steer loader 10 is limited in order to provide maneuverability and thus the mounting space for all of the components is limited. There is a need for providing cooling airflow for the hydraulic oil cooler, sometimes an engine radiator and if installed, an air conditioner condenser. Also a hydraulic reservoir is needed for providing hydraulic fluid for the pump 20 to accommodate these needs. The present invention comprises a integrated assembly 30 that combines an air inlet plenum, a heat exchanger, a fan, a fan shroud, a fan mount, a pair of air outlet ducts and a fluid reservoir. The integrated assembly 30 is mounted just ahead of the forward end 32 of the engine compartment 16, and behind the rear wall 15 of the cab 14.

Figure 1A:
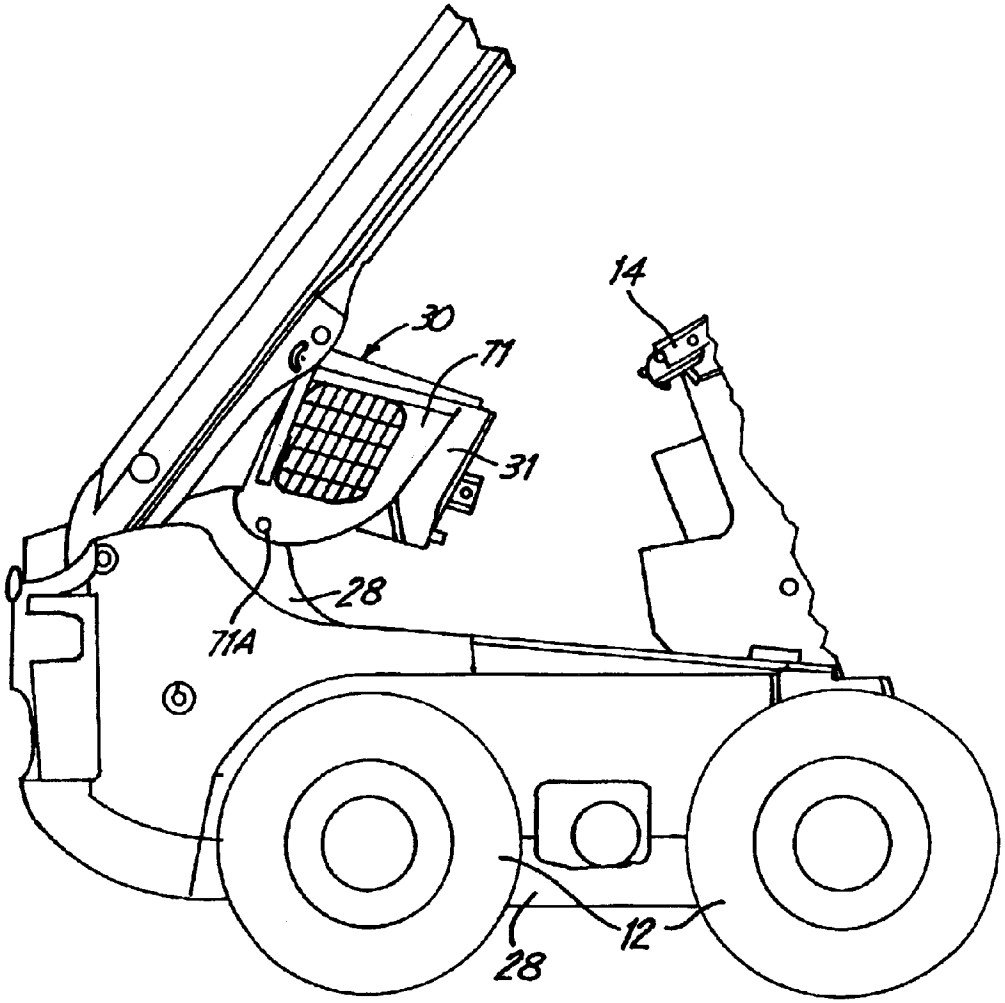
FIG. 1A is a side view of the loader with an integrated assembly pivoted upwardly for access to lower loader components.

The integrated assembly 30, as can be seen, is mounted in place on the frame of the skid steer loader using suitable pivot brackets and pivot stops that pivotally support the tank on the frame as a unit. The tank will swing up for access to components below the tank, as shown in FIG. 1A.

Figure 2:
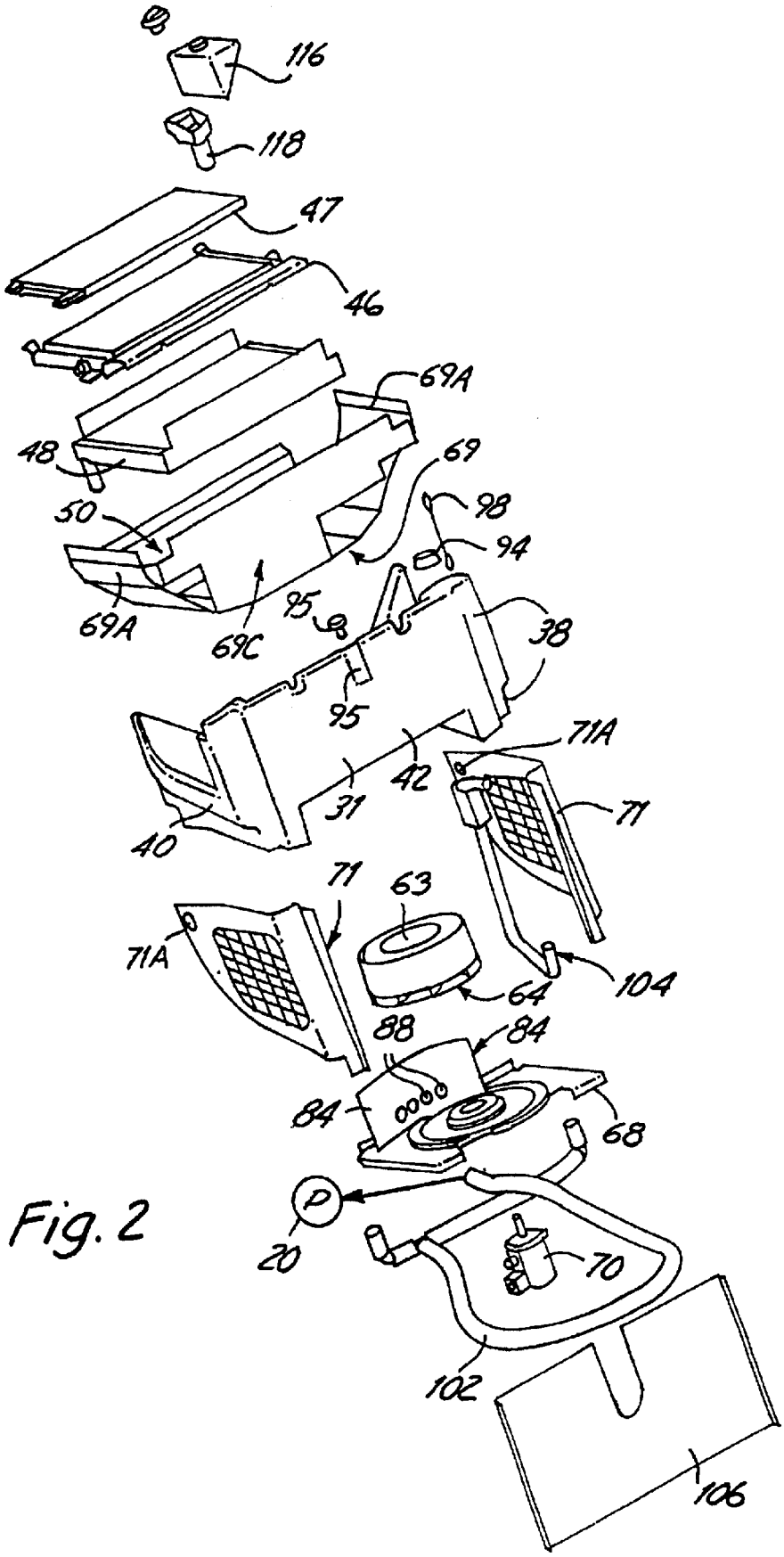
FIG. 2 is an exploded view of the integrated assembly installed in the skid steer loader of FIG. 1 shown in a top, front perspective.
Figure 3:
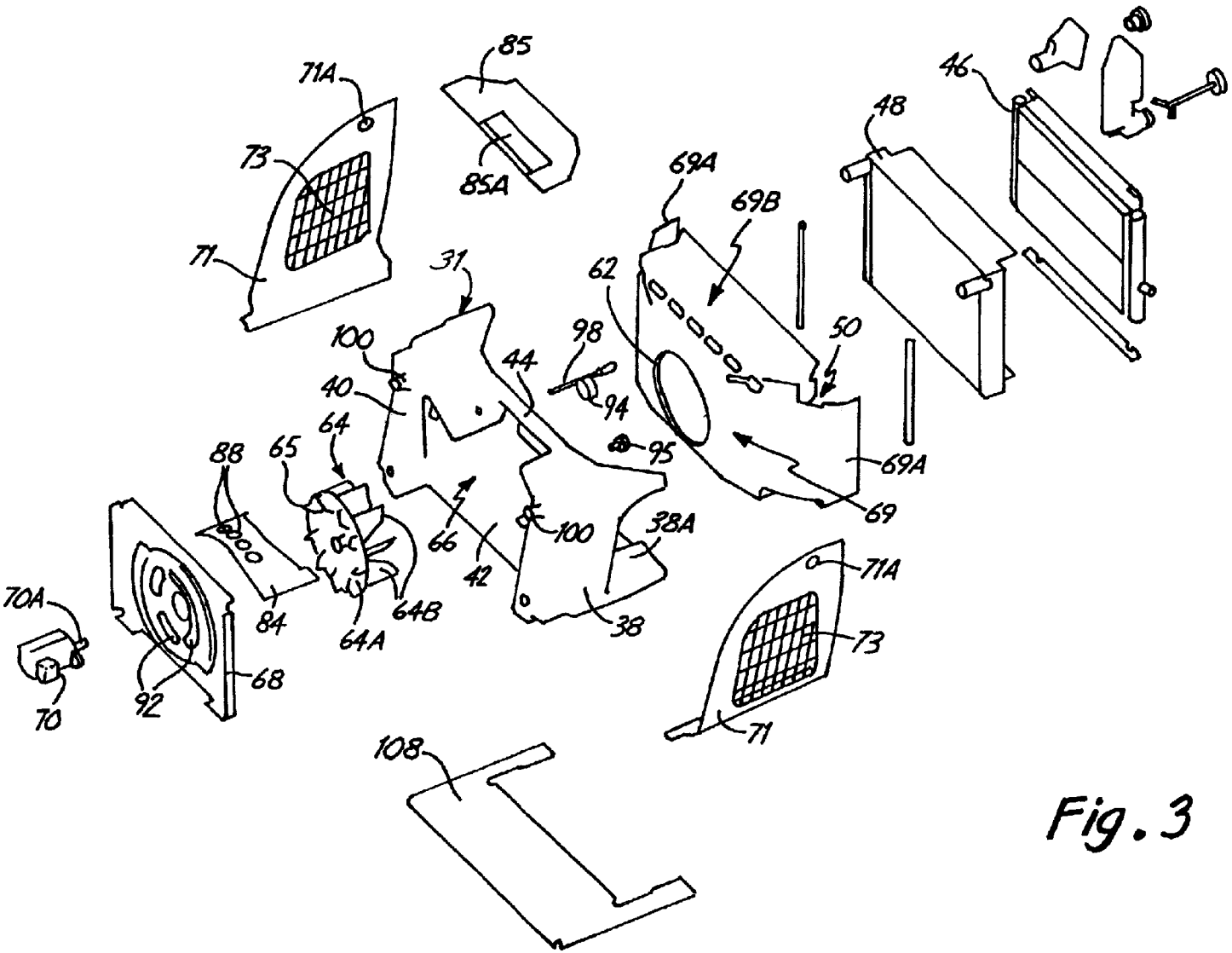
FIG. 3 is an exploded view of an integrated assembly of FIG. 2 taken in a bottom, rear perspective.
Figure 4:
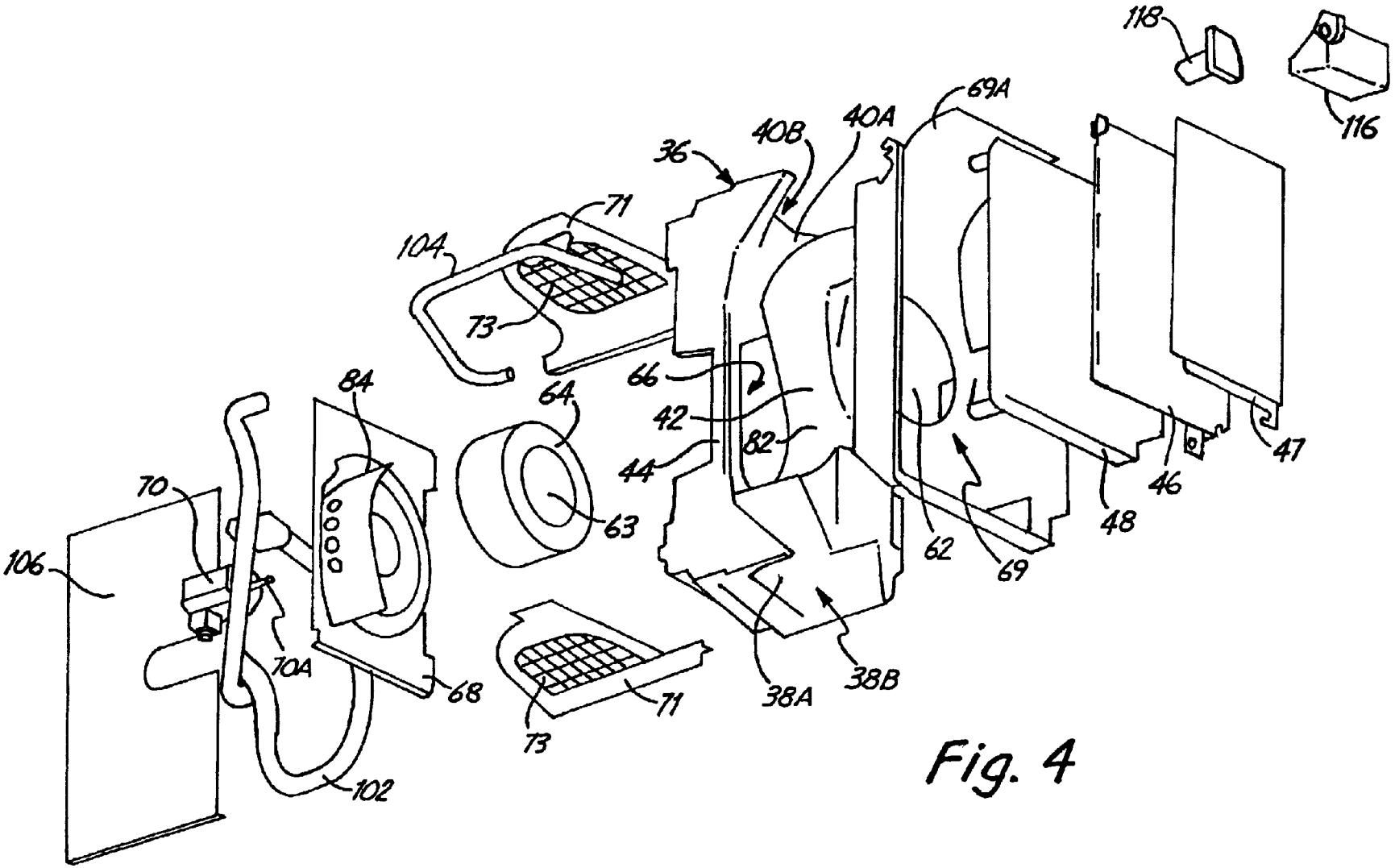
FIG. 4 is an exploded view of major components used in the integrated assembly taken from a top rear perspective.

Referring specifically to FIGS. 2, 3 and 4, exploded views of the integrated assembly 30 are illustrated. The combined component or integrated assembly 30 shown in FIGS. 2 and 3 has a number of components that are vertically stacked and secured together.

The integrated assembly 30 includes a molded, unitary tank 31 with ducts which is rotationally molded from a suitable plastic material. The tank 31 with ducts is formed with hollow compartments and curved or contoured walls. The tank 31 with ducts forms a cooling air fan shroud and has a first side tank portion 38, a second side tank portion 40, a front wall tank portion 42, and a rear cross over connector tube 44.

The side tank portions 38 and 40 are spaced apart in lateral direction (side to side) on the loader and are joined by the front tank portion and rear cross connector over 44. The cross over connector tube 44 forms a structural support or connection to hold the side tank portions as a unit, as well as forming a fluid passageway between the interior chambers of the side tank portions. The side tank portions, front tank portion and the cross over portion are all hollow and form interior chambers. The chambers of the tank portions are all fluidly open to each other. The side tank portions are formed to define laterally diverted channels 38A and 40A that form airflow outlet ducts, and together with the wall 82 of tank portion 42 and cross over 44 define a central fan chamber 66. A fan support plate 68 closes the lower side of the fan chamber 66, and a formed, bath tub shaped fan inlet plate 69 is supported above the fan chamber and forms a top wall over the walls 38A and 40A to form air discharge ducts 38B and 40B leading from the fan chamber 66.

The inlet plate 69 is recessed in the center and provides the bottom for a plenum chamber 50 between the upper parts of the front and side tank portion in which cooling components are mounted in a suitable manner. The sides of plenum chamber 50 are enclosed with upwardly extending, accurate side panels 69A formed as part of the inlet plate 69. The inlet plate and other walls forming the plenum chamber can be made of individual components as shown or can be die formed or molded as a unitary structure.

The heat exchanger components include a hydraulic oil cooler or radiator 46, which fits within the plenum chamber 50 between the side panels 69A. The inlet plate 69 and an engine coolant radiator 48 is mounted below and spaced from the hydraulic oil cooler 46. An air conditioning condenser 47 can be installed above as well, when an air conditioning system is used for the cab 14. These cooling components are all nested within the plenum chamber 50 between the upper parts of the side tank portions 38 and 40 and the front wall tank portion 42 and crossover 44. The condenser 47, hydraulic 46 oil cooler and radiator 48 components can be fastened or secured to panels 69B and 69C of the fan inlet plate 69, which in turn is secured to side shields 71, panel wall 85, plate 106 or plate 108, and then to mounting plate 68 with cap screws or other fasteners in a desired manner.

Figure 7:
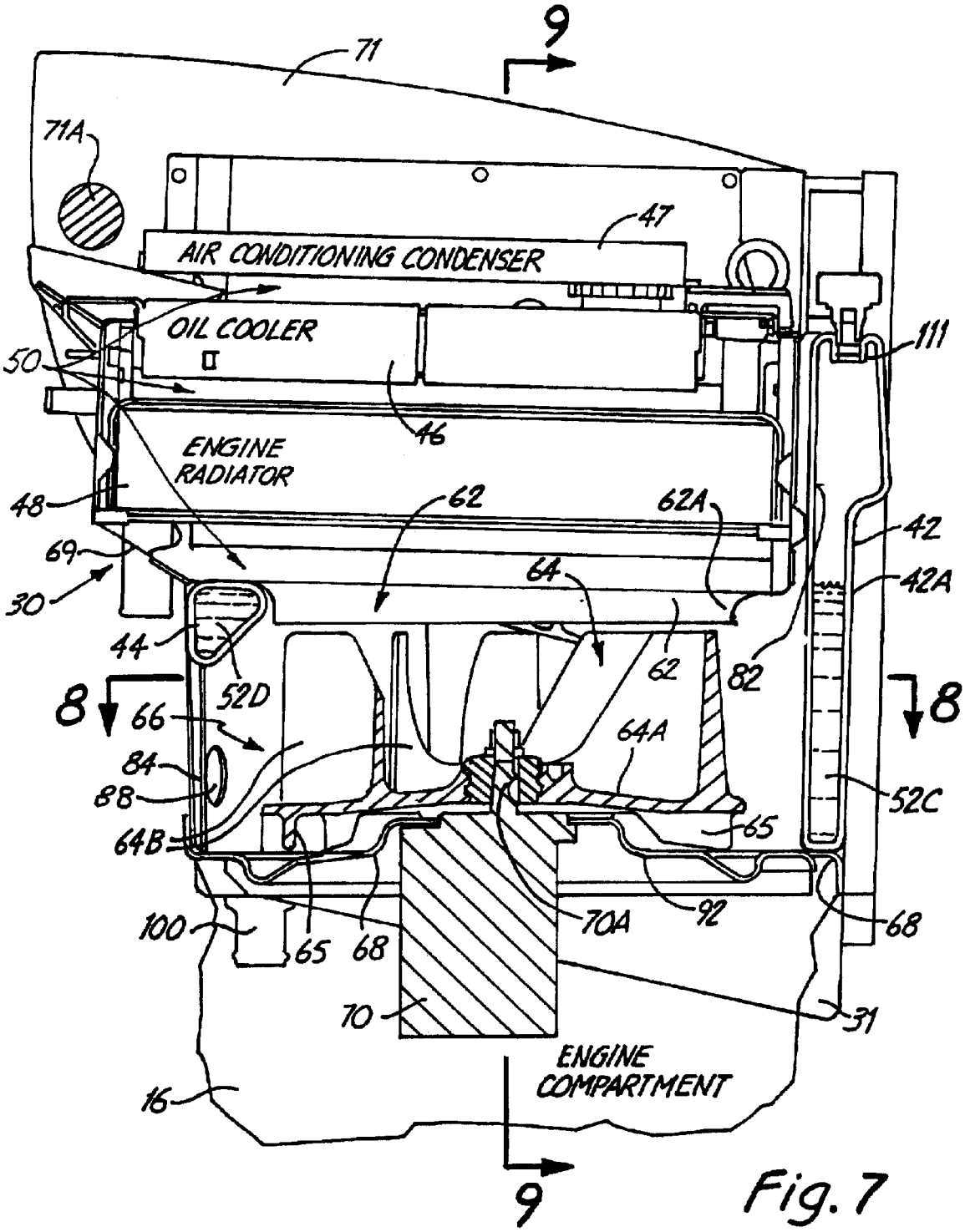
FIG. 7 is a side view of the integrated assembly with parts in section and parts broken away.

The tank 31 with ducts has interior chambers that hold hydraulic fluid including chambers 52A and 52B in the side tank portions 38 and 40 (FIG. 5), chamber 52C in the front wall tank portion 42 and chamber 52D in the cross over 44 (FIG. 7). The chambers are formed by enclosing walls, as shown. The front wall tank portion 42 extends from the fan mounting or support plate 68 all the way to the top of the plenum chamber 50 (FIG. 7). The wall 82 of the front tank portion 42 thus is adjacent to the front wall of plenum chamber 50. The walls 82 and 42A, and hydraulic fluid or oil shown in the tanks provides sound insulation from the fan chamber 66.

The fan inlet plate 69 forms the bottom wall of the plenum chamber 50 and has a central opening 62 that provides an air inlet to the center 63 of a radial blade fan 64, which is mounted in the fan chamber 66. The fan 64 has a base plate 64A that is drivably mounted onto a shaft 70A of a fan drive motor 70, which is mounted to the fan mounting plate 68. Output shaft 70A drives the fan 64. The fan 64 is a radial fan having the base fan plate 64A and main generally radial blades 64B extending upwardly from plate 64A, as presently used for skid steer loader engine cooling, as shown in U.S. Pat. No. 4,962,825.

Figure 8:
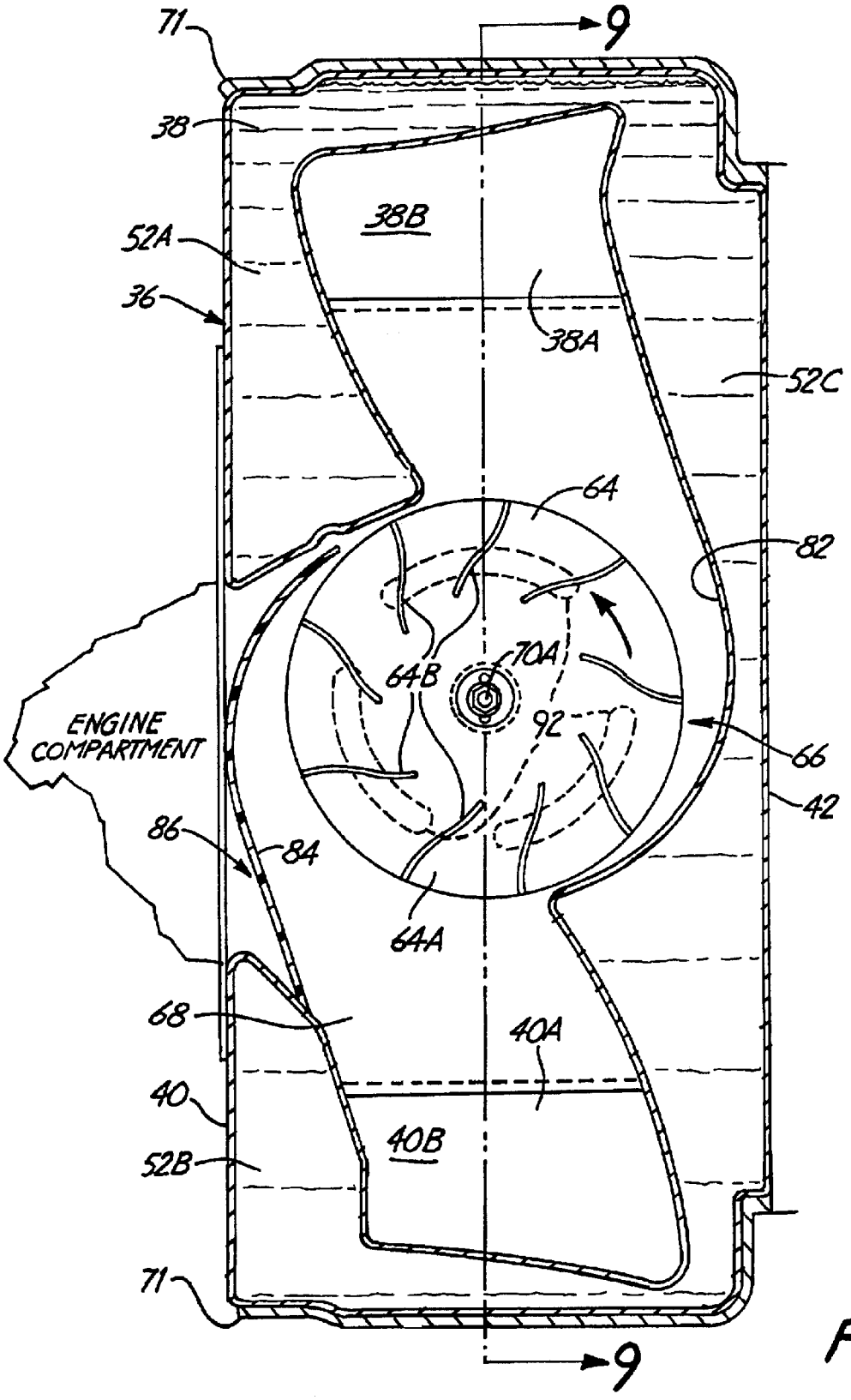
FIG. 8 is a longitudinal sectional view taken generally along line 8—8 in FIGS. 7 and 9.
Figure 9:
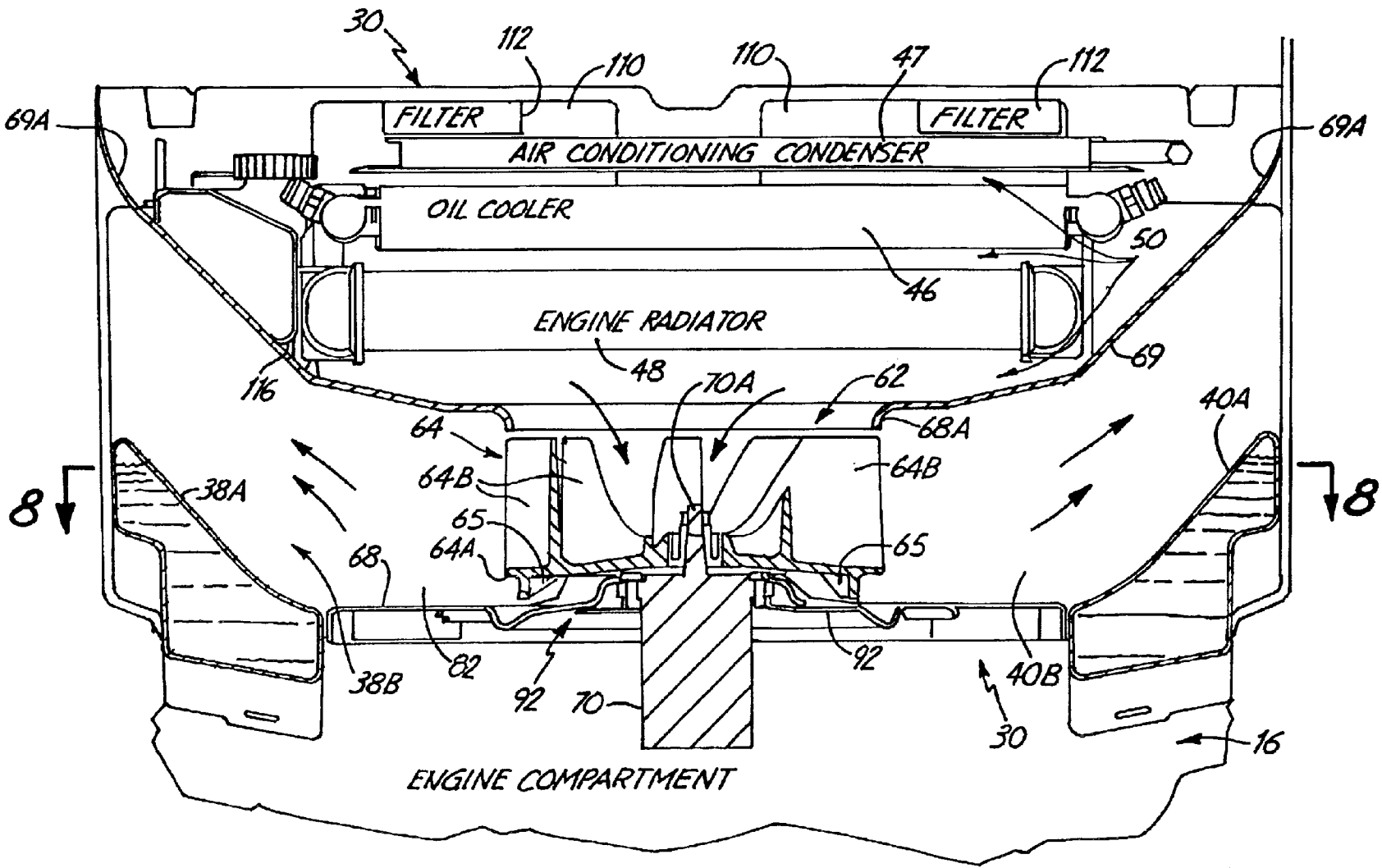
FIG. 9 is a sectional view taken along line 9—9 in FIGS. 7 and 8.

Referring to FIGS. 7, 8 and 9 the fan 64 and motor 70 are shown in place on the mounting plate 68. The mounting plate 68 has openings 92 under the fan plate 62A. The tank 31 is supported by mounting plate 68. Shields 71 (FIG. 2) that are on the right and left-hand sides of the tank 31 and have air discharge grates 73 (see FIGS. 1 and 2) formed thereon. The side shields 71 are mounted on the frame 28 of the skid steer loader 10. Suitable brackets are used for pivotally mounting the side shields 71 to the frame at pivot points 71A so the entire integrated assembly can be pivoted up for service.

As shown in FIG. 8, the fan chamber 66 is defined by the scroll type wall 82 formed as the interior wall of the front tank portion 42. An air deflector wall 84 is mounted on the rear side of the fan below cross over 44. There is a space or gap 86 between the side tank portions 38 and 40 at the rear of the tank 31 and below the tubular cross over 44. This space 86 is closed with a panel wall 85 that has an opening 85A in the center (see FIG. 5). The air deflector wall 84 aligns with opening 85A. The air deflector wall 84 is a formed plate that has openings 88 that provide a controlled airflow into the engine compartment. The air deflector wall 84 is preferably metal, as are the fan support or mounting plate 68 and the fan inlet plate 69. The air deflector wall 84 is fastened to mounting plate 68 in a suitable manner to enclose the fan chamber. The deflector wall 84 is supported on the fan mounting plate 68.

Inlet opening 62 from plenum chamber 50 to fan chamber 66 for the fan has an annular flow guide ring 62A that provides a smooth flow path for the incoming air. Incoming air is drawn down through the air conditioning condenser 47 (if used), the hydraulic fluid cooler 46, and the engine coolant radiator 48 so that cool exterior air comes in from the top of the skid steer loader, and then through the plenum chamber 50 to the fan 64. The air that is warmed or heated after passing through the heat exchangers is discharged by the fan out through side air outlet ducts 38B and 40B which are formed by the molded channel walls 38A and 40A.

The fan 64 has lower radial blades 65 fixed to and positioned below the fan plate 64A, which will draw air from the engine compartment 16 through openings 92 in fan support or mounting plate 68 and will discharge hot engine compartment air out through ducts 38B and 40B.

The hot air is discharged through the outlet openings comprising grates 73 formed in side shields 71. The outlet openings face laterally, so there is a lateral or sideways discharge from the fan.

It should be noted, as shown in FIG. 9, for example, that the lower walls of ducts 38B and 40B and the side walls 69A of the fan inlet plate 69 are inclined or swept upwardly. This means that the hot air will be discharged laterally and upwardly.

Thus, when the fan motor 70 is running, the fan blades rotate and air will flow from the exterior down through the plenum chamber 50 for cooling the components such as the hydraulic oil radiator 46, and the engine coolant radiator 48, and will pass into the fan chamber 66 where it will be discharged laterally out through one or both of the side discharge ducts 38B and 40B.

As can be seen in FIG. 3, the tank 31 with ducts shroud has a suitable fill opening covered by a fill cap 94 and a dipstick 98 that is used for determining the level of the hydraulic oil in the tank. The breather element is in a molded support 95 at the front of the tank to vent the tank chamber 52. The front wall of the tank extends upwardly to near the top of the plenum so it not only reduces noise, but raises the support for the vent up so a long tube is not required to bring the breather above the normal liquid level in the tank. The tank with shroud 31 has outlets 100 (FIG. 5) that connect to inlet of suction hoses 102 (FIG. 2) that connect to the pump 20 (FIG. 1). The pump inlet hoses 102 are close to the hydraulic pump. The hydraulic fluid return line or hose 104 from hydraulic components returns flow to the bottom of the tank 31.

The integrated assembly 30 can thus be put into place on the loader frame after the fan 64 and the heat exchangers have been installed. The assembly can be supported on the frame of the loader in a desired convenient manner.

The integrated assembly 30 is provided with a metal front shield between the rear wall of the cab and the front tank portion 42. Two forms of the front shield are illustrated. When no air conditioning system is provided, a plate 106 (FIG. 2) that covers the entire front tank wall is used. The plate has an opening for the molded vent (breather) support 95.

Figure 5:
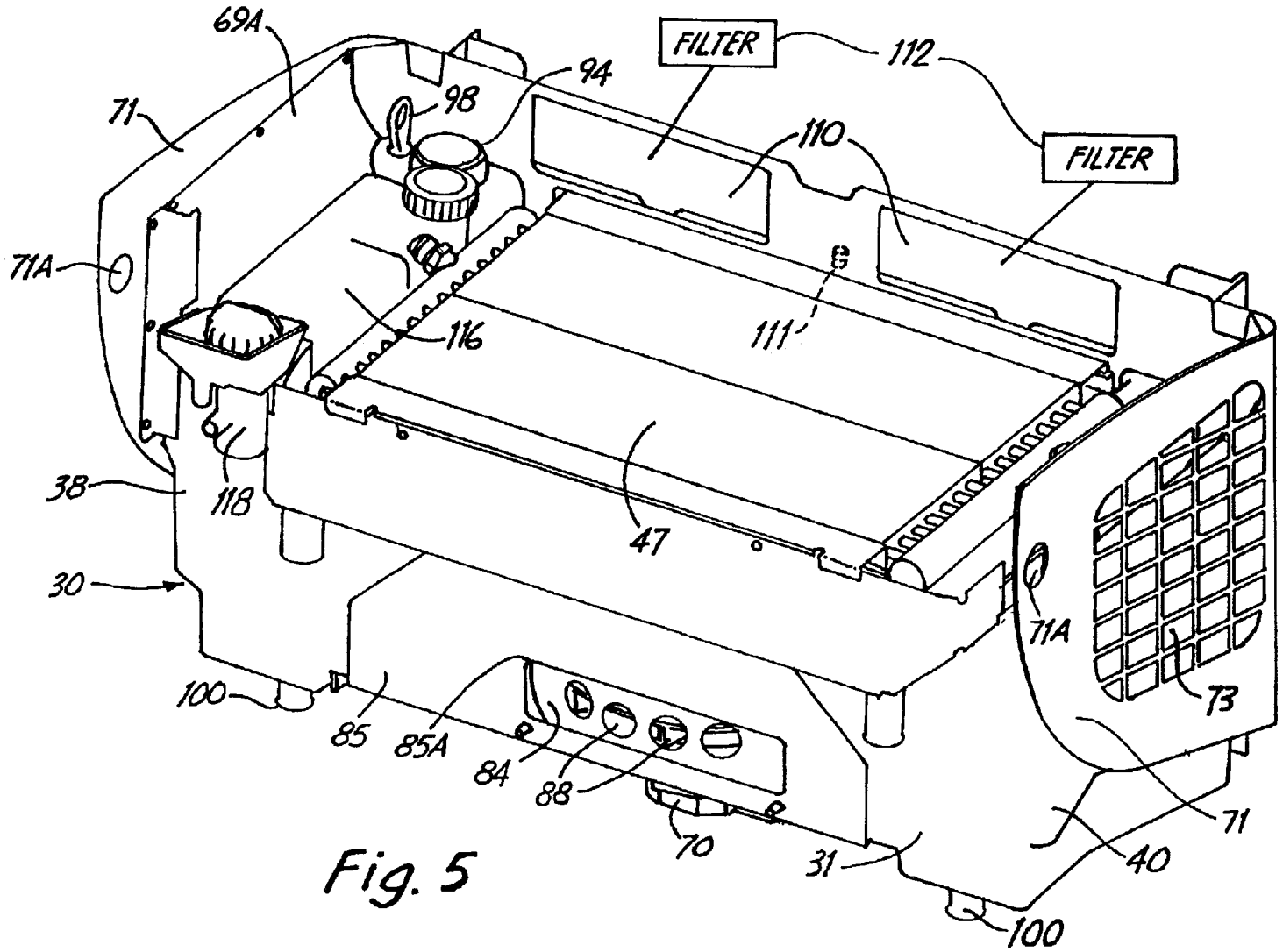
FIG. 5 is a perspective top rear view of the integrated assembly of the present invention.
Figure 6:
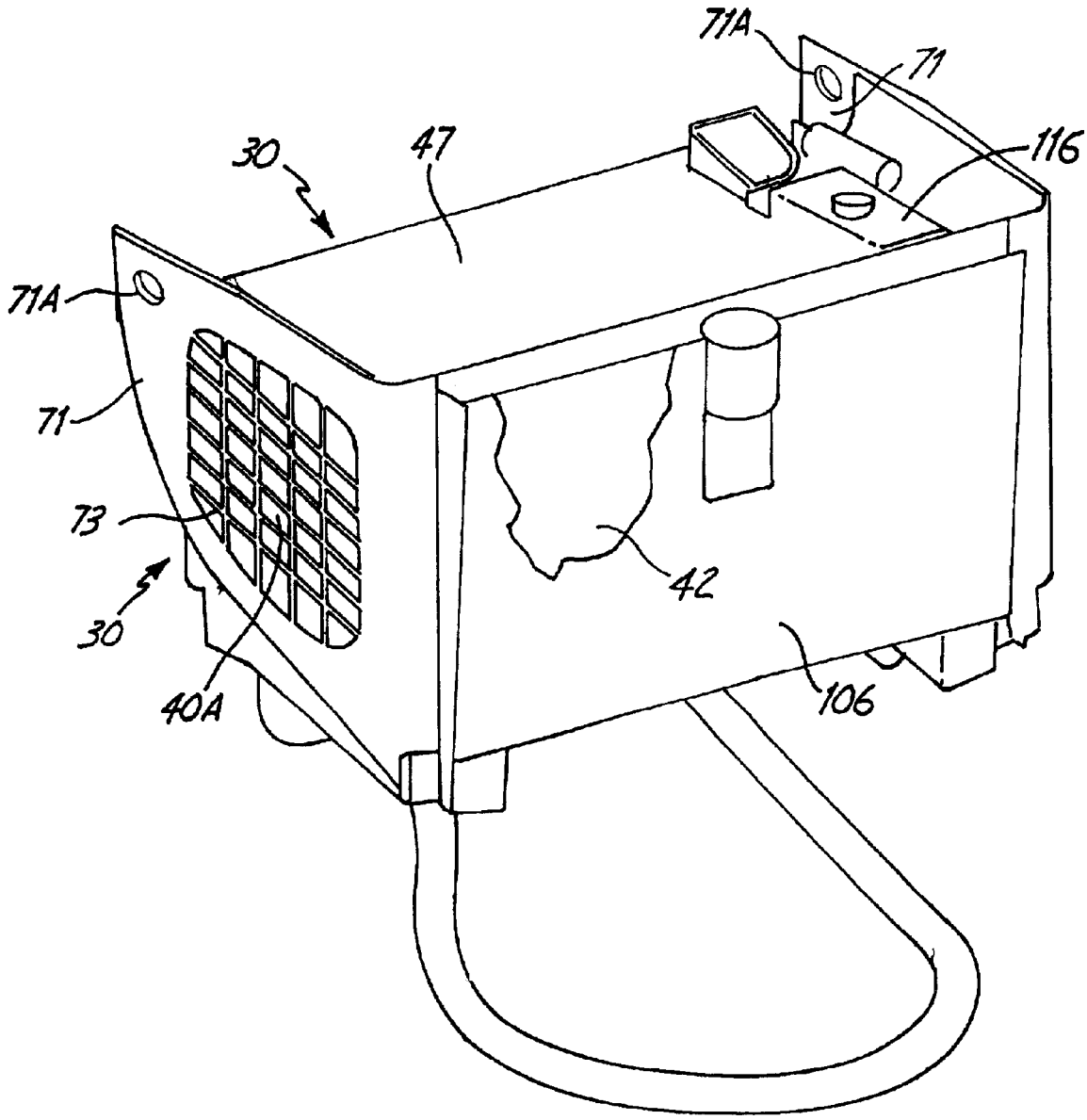
FIG. 6 is a front top perspective view showing the basic integrated assembly.

When an air conditioning system is used, a front plate 108, shown in FIG. 3, that is recessed at the top is used. Also as shown in FIG. 5, openings 110 for filters 112 for cab inlet air can be provided.

The tank with ducts 31 can be rotationally molded or blow molded from a homogeneous plastic material of suitable composition to avoid degradation under the conditions of operation of a skid steer loader, and also to avoid degradation from hydraulic fluids. As shown in FIGS. 2 and 5, there is a recess for a coolant recovery bottle 116. A fuel fill inlet 118 can be mounted adjacent to the tank assembly and is connected with a suitable pipe to a fuel tank located below the integrated assembly 30.

The tank with ducts 31 and attached components, including the fan and the side guards can be preassembled and then mounted in the skid steer loader. As shown in FIG. 1A, the tank assembly can be rotated about pivot mounting at 71A for access to components mounted below the tank assembly. The entire tank assembly pivots out of the way, and latches can be used to hold it closed. Also, a support such as a precharged gas cylinder can be used to aid in raising the tank assembly and it can be propped up when opened.

The compact cooling system of the present invention is enabled by integration of both the hydraulic fluid reservoir and the cooling system fan housing or shroud into one molded or cast component. The cooling fan chamber is defined as two scroll wipers, namely walls 82 and 84, and two expansion scrolls or ducts 38B and 48B, and two scroll outlets which direct flow upwardly.

An air inlet plenum 50 directs airflow through a stack of heat exchangers to an inlet opening to the fan defined by a smooth ring 62A that maintains a smooth airflow. The molded tank has space for a coolant recovery bottle, and forms a fill cap neck and a dipstick socket, as well as a reservoir vent port 111 (see FIG. 5). Hydraulic flow outlet and return ports such as those shown at 100 can be integrally molded.

The molded tank can provide hydraulic return baffles on the interior, and hydraulic outlets sumps as well. As shown there are hydraulic fluid and/air separation surfaces so that the tanks are actually subjected to the cooling air as well.

This one component thus is a housing for a cooling fan and its drive, and for mounting air conditioner condensers, hydraulic fluid coolers, an engine cooler, and a coolant recovery bottle as well as the components mentioned above.

The assembly provides a reduced number of components which in turn means a reduced number of tooling developments. The assembly is modular, with the main component being the molded tank, and then the fan support, and the fan inlet plate being added easily. It should be noted that the cooling airflow ducts leading to the outlet serve as internal integrated hydraulic return flow baffles, because of the differences in the shapes of the chambers in the tank. A reservoir for the hydraulic fluid actually wraps around the heat exchangers to provide large areas for separating air from the hydraulic fluid, while the molded or cast shape of the component provides for rounded or smooth edges on surfaces to exchange airflow for cooling on both the inlet and outlet sides of the cooling fan inlet, and the walls defining the fan chamber. The tank mounts closely to the components that are used, so their hose extensions to a remote fill cap and a reservoir vent and dipstick are not needed. Integration of the cooling air duct work allows for compact packaging of the cooling system and hydraulic reservoir components, which allows efficient space utilization in a loader vehicle where space is at a premium.

The double wall construction of the front tank in particular, as well as the other tanks, provide sound barriers between the fan noise and the loader operator or bystanders. Hydraulic fluid between the double walls of the tank dampens the noise harmonics to aid in reducing noise levels.

Although the present invention has been described with reference to preferred embodiments, workers skilled in the art will recognize that changes may be made in form and detail without departing from the spirit and scope of the invention.

What is claimed is:

1. A molded tank and cooling component housing for a powered loader comprising a tank structure having first and second spaced apart side tank portions and a front tank portion joining the side tank portions, said tank portions having interior chambers that are in fluid communication with each other, the side and front tank portions forming an opening partially surrounded by the side and front tank portions, the opening, having a first section having first and second ends forming a fan chamber, a fan mounted in the fan chamber between the first and second ends of the fan chamber and adjacent a second end, the opening defining a plenum chamber between the fan chamber and the first end, the plenum chamber including at least one component through which air passes for cooling the component, the fan moving air through the plenum chamber, and discharge ducts extending from the fan chamber through passageways formed by surfaces of the side tank portions and opening to the exterior of the molded tank, wherein the surfaces of the side tank portions forming the discharge ducts incline upwardly in a lateral direction from the fan chamber to an outlet on a side of the powered loader.

2. The tank of claim 1 and a crossover tube at a rear of the opening structurally supporting rear ends of the side tank portions relative to each other.

3. The tank of claim 2, wherein the crossover tube defines a passageway joining the interior chambers formed in the respective side tank portions.

4. The tank of claim 1 and a fan support plate at the second end of the fan chamber, the fan support plate having openings to provide an inlet to a portion of the fan.

5. The tank of claim 1, wherein the tank is a unitary tank wherein the side tank portions and front tank portions are molded together as a single integral and continuous unit.

6. The tank of claim 1, wherein the front tank portion extends from the first end to the second end and laterally between the side tank portions, the front wall portion being between the fan chamber and a rear wall of an operator's cab on the powered loader.

7. The tank of claim 1 and a fan inlet plate overlying the fan chamber and the passageway to form a further portion of the discharge duct.

8. The tank of claim 7, wherein the fan inlet plate has upwardly extending walls that further define the plenum chamber.

9. The tank of claim 4, wherein the fan is a double fan having an upper section and a lower portion, the lower portion being adjacent to the fan support plate.

10. The tank of claim 9, wherein the side tank portions are spaced apart at a rear side, a scroll deflector plate extending between the side tank portions at the rear and having openings for discharging air from the fan into an engine compartment.

11. A tank and cooling component housing for a powered vehicle, comprising:

a tank structure, having first and second spaced apart side tank portions and at least a forward tank portion joining the side tank portions, said tank portions having interior chambers that are in fluid communication with each other;

a fan chamber surrounded by the tank portions;

a fan mounted in the fan chamber;

airflow ducts formed by walls of the side tank portions to carry discharge air from the fan, the fan chamber including at least one component through which air passes to a fan inlet for cooling the component, the fan moving air past the component to the airflow ducts; and wherein the walls of the side tank portions forming airflow ducts incline upwardly in a lateral direction from the fan chamber to an outlet on a side of the powered vehicle.

12. The tank of claim 11, wherein the tank is molded as a unit and includes walls forming a support between the side tank portions spaced from the front wall.

13. The tank of claim 12, wherein the support comprises a crossover tube structurally supporting the side tank portions relative to each other and having an interior chamber joining the interior chambers of the side tank portions.

14. The tank of claim 11, wherein the forward tank portion has a height extending from a first end to a second end and laterally between the side tank portions, the forward tank portion configured for being between the fan chamber and a rear wall of an operator's cab of the powered vehicle.

15. The tank of claim 11, further comprising a fan inlet plate overlying the fan chamber and the laterally extending airflow ducts to form enclosed lateral ducts leading from the fan chamber.

16. A tank and cooling component housing for a powered vehicle, comprising:

a tank structure, having first and second spaced apart side tank portions and at least a forward tank portion joining the side tank portions, said tank portions having interior chambers that are in fluid communication with each other;

a fan chamber surrounded by the tank portions;

a fan mounted in the fan chamber;

airflow ducts formed by walls of the side tank portions to carry discharge air from the fan, the fan chamber including at least one component through which air passes to a fan inlet for cooling the component, the fan moving air past the component to the airflow ducts; and a fan support plate at an end of the fan chamber, the fan support plate having openings to provide an inlet to a portion of the fan on an opposite side of the fan from the at least one component.

17. The tank of claim 16 wherein the fan is a double fan having an upper section and a lower portion, the lower portion being adjacent to the fan support plate.

18. A tank and cooling component housing for a powered vehicle, comprising:

a tank structure, having first and second spaced apart side tank portions and at least a forward tank portion joining the side tank portions, said tank portions having interior chambers that are in fluid communication with each other;

a fan chamber surrounded by the tank portions;

a fan mounted in the fan chamber;

airflow ducts formed by walls of the side tank portions to carry discharge air from the fan, the fan chamber including at least one component through which air passes to a fan inlet for cooling the component, the fan moving air past the component to the airflow ducts;

a fan inlet plate overlying the fan chamber and the laterally extending airflow ducts to form enclosed lateral ducts leading from the fan chamber, wherein the fan inlet plate has upwardly extending walls that define a plenum chamber, there being at least one cooling component mounted in the plenum chamber.

* * * * *

UNITED STATES PATENT AND TRADEMARK OFFICE

CERTIFICATE OF CORRECTION

PATENT NO. : 6,871,697 B2 
DATED : March 29, 2005
INVENTOR(S) : Larry E. Albright, Lonnie D. Hoechst and Daniel A. Frederick It is certified that error appears in the above-identified patent and that said Letters Patent is hereby corrected as shown below:

Column 6,
Line 57, cancel the text beginning with "1. A molded tank" to and ending "a side of the powered loader." in Column 7, line 10, and insert the following claim:

1. A molded tank and cooling component housing for a powered loader comprising a tank structure having first and second spaced apart side tank portions and a front tank portion joining the side tank portions, said tank portions having interior chambers that are in fluid communication with each other, the side and front tank portions forming an opening partially surrounded by the side and front tank portions, the opening having a first section having first and second ends forming a fan chamber, a fan mounted in the fan chamber between the first and second ends of the fan chamber and adjacent a second end, the opening defining a plenum chamber between the fan chamber and the first end, the plenum chamber including at least one component through which air passes for cooling the component, the fan moving air through the plenum chamber, and discharge ducts extending from the fan chamber through passageways formed by surfaces of the side tank portions and opening to the exterior of the molded tank, wherein the surfaces of the side tank portions forming the discharge ducts incline upwardly in a lateral direction from the fan chamber to an outlet on a side of the powered loader.

Signed and Sealed this

Twenty-first Day of June, 2005

JON W. DUDAS
*Director of the United States Patent and Trademark Office*